US005297749A

United States Patent [19]

White

[11] Patent Number: 5,297,749

[45] Date of Patent: Mar. 29, 1994

[54] BED MOUNTED TISSUE ROLL HOLDER APPARATUS

[76] Inventor: Mark E. White, 16 Hacker St., Fairhaven, Mass. 02719-1808

[21] Appl. No.: 982,909

[22] Filed: Nov. 30, 1992

[51] Int. Cl.[5] ..... A47K 10/22; A47K 10/32

[52] U.S. Cl. ..... 242/55.2; 242/55.54

[58] Field of Search ..... 242/55.2, 55.53, 55.54, 242/55.3, 55.42; D6/518, 520–523

[56] References Cited

U.S. PATENT DOCUMENTS

| | | | |
|---|---|---|---|
| 2,518,328 | 8/1950 | Janonis | 242/55.2 |
| 2,916,223 | 12/1959 | Klim | 242/55.2 |
| 3,721,395 | 3/1973 | Snipes | 242/55.53 |
| 3,806,055 | 4/1974 | Bauman | 242/55.2 |
| 4,218,027 | 8/1980 | Pool | 242/55.2 |
| 4,453,680 | 6/1984 | Miller | 242/55.53 |
| 4,513,923 | 4/1985 | Ulics | 242/55.2 |
| 4,741,486 | 5/1988 | Ancona et al. | 242/55.2 |
| 4,824,038 | 4/1989 | Chandler | 242/55.2 |
| 5,167,377 | 12/1992 | Chalmers | 242/55.2 |

FOREIGN PATENT DOCUMENTS

| | | | |
|---|---|---|---|
| 652307 | 3/1929 | France | 242/55.2 |

*Primary Examiner*—Daniel P. Stodola
*Assistant Examiner*—John Q. Nguyen
*Attorney, Agent, or Firm*—Leon Gilden

[57] ABSTRACT

A spring clip mounts a mounting tube thereon, wherein the mounting tube receives a tissue roller rotatably thereabout, and the mounting tube having a cap removably mounted therefrom, with the cap coaxially aligned with the mounting tube, including projections fixedly mounted to the cap to extend over the tissue roll to secure the tissue roll between the cap and the spring clip structure.

1 Claim, 4 Drawing Sheets

BED MOUNTED TISSUE ROLL HOLDER APPARATUS

BACKGROUND OF THE INVENTION

1. Field of the Invention

The field of invention relates to tissue dispenser structure, and more particularly pertains to a new and improved bed mounted tissue roll holder apparatus wherein the same is arranged for the mounting and dispensing of tissue paper relative to a bed assembly.

2. Description of the Prior Art

The use of tissue relative to bed-ridden patients and invalids in a nursing and hospital scenario is effected in the prior art by merely positioning a tissue roll for convenience for use by a staff member or individual. The instant invention attempts to overcome deficiencies of the prior art by providing for a tube member to support the tissue roll permitting ease of access to the tissue roll and its positioning relative to use. Prior art tissue dispensers have heretofore failed to provide this manner of mounting the tissue roll structure and such examples are indicated in U.S. Pat. Nos. 4,607,809; 4,634,067; 4,373,682; and 4,103,838.

SUMMARY OF THE INVENTION

In view of the foregoing disadvantages inherent in the known types of tissue dispenser structure now present in the prior art, the present invention provides a bed mounted tissue roll holder apparatus wherein the same is arranged for the mounting of a tissue roll holder relative to a bed for subsequent dispensing of tissue therefrom. As such, the general purpose of the present invention, which will be described subsequently in greater detail, is to provide a new and improved bed mounted tissue roll holder apparatus which has all the advantages of the prior art tissue dispensing apparatus and none of the disadvantages.

To attain this, the present invention provides a spring clip mounting a mounting tube thereon, wherein the mounting tube receives a tissue roller rotatably thereabout, and the mounting tube having a cap removably mounted therefrom, with the cap coaxially aligned with the mounting tube, including projections fixedly mounted to the cap to extend over the tissue roll to secure the tissue roll between the cap and the spring clip structure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved bed mounted tissue roll holder apparatus which has all the advantages of the prior art tissue dispensing apparatus and none of the disadvantages.

It is another object of the present invention to provide a new and improved bed mounted tissue roll holder apparatus which may be easily and efficiently manufactured and marketed.

It is a further object of the present invention to provide a new and improved bed mounted tissue roll holder apparatus which is of a durable and reliable construction.

An even further object of the present invention is to provide a new and improved bed mounted tissue roll holder apparatus which is susceptible of a low cost of manufacture with regard to both materials and labor, and which accordingly is then susceptible of low prices of sale to the consuming public, thereby making such bed mounted tissue roll holder apparatus economically available to the buying public.

Still yet another object of the present invention is to provide a new and improved bed mounted tissue roll holder apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
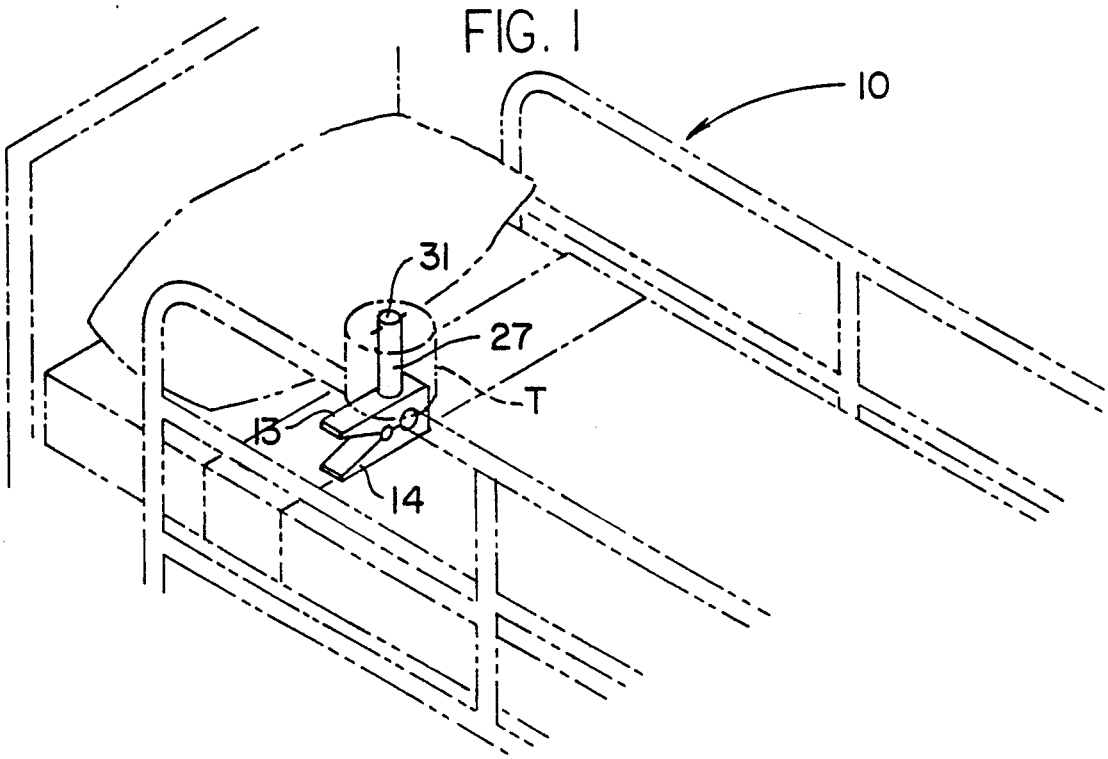
FIG. 1 is an isometric illustration of the instant invention.
Figure 2:
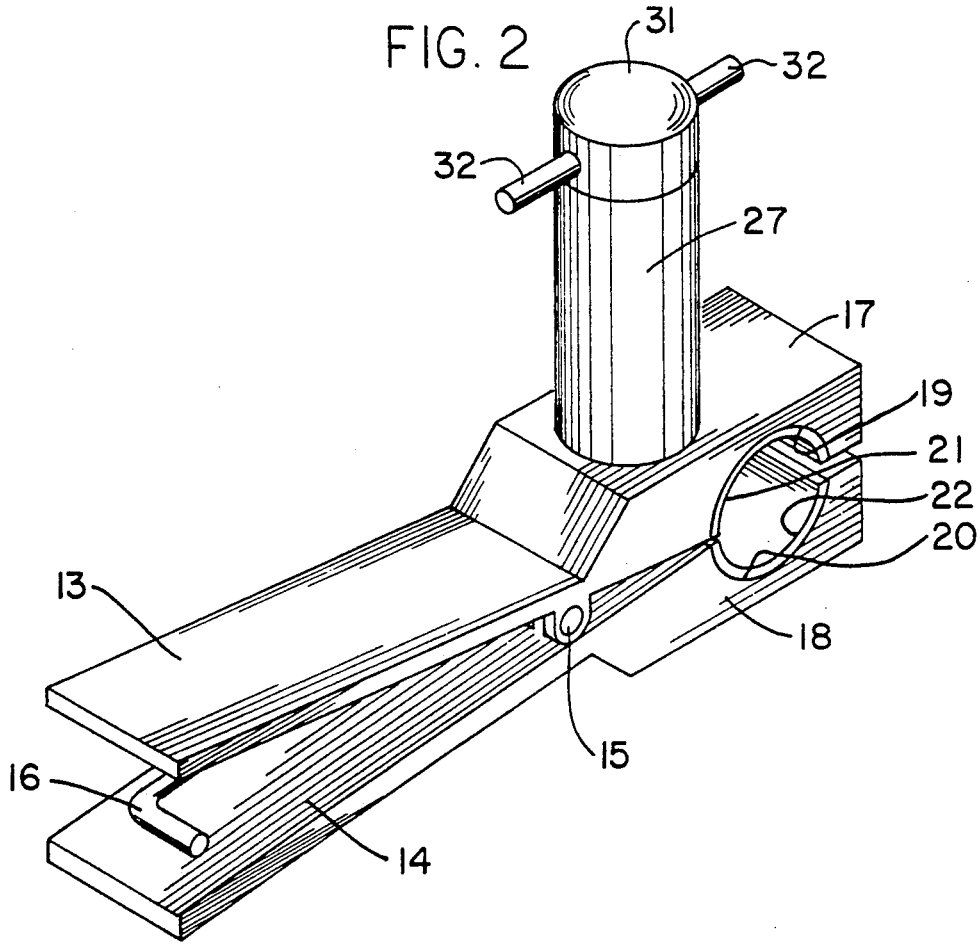
FIG. 2 is an isometric illustration, somewhat enlarged, of the invention as indicated in FIG. 1.
Figure 3:
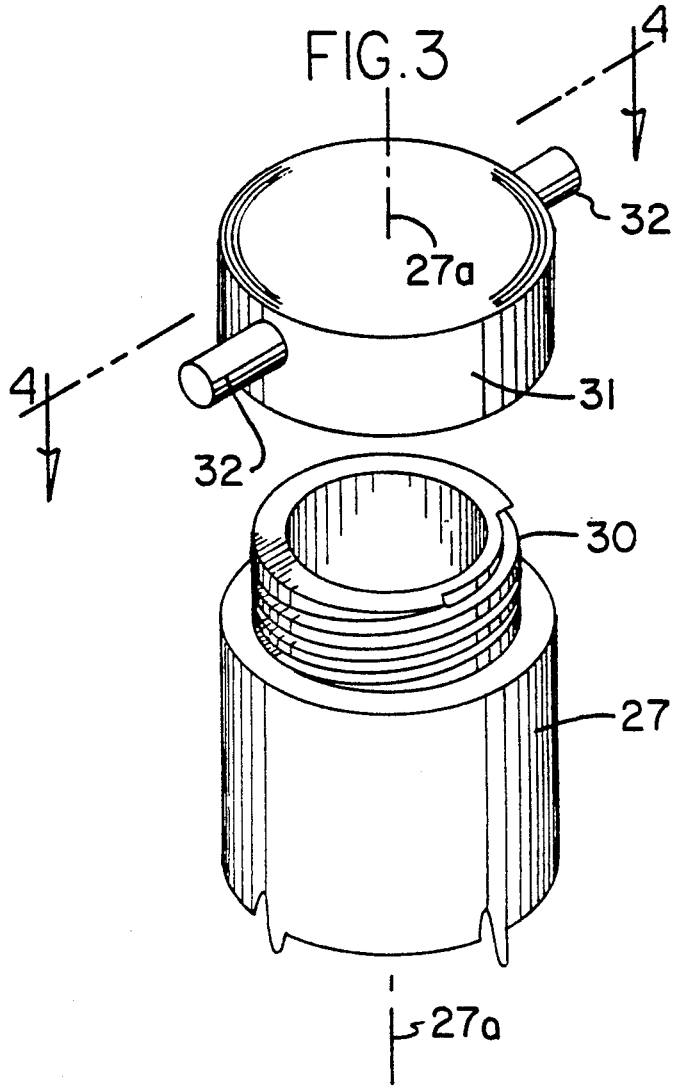
FIG. 3 is an isometric illustration of the cap structure relative to the mounting cylinder of the invention.
Figure 4:
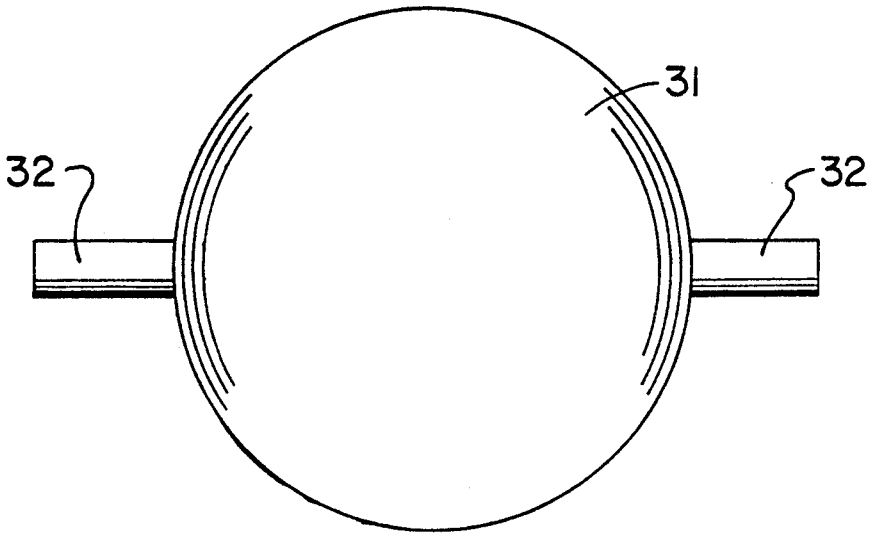
FIG. 4 is an orthographic view, taken along the lines 4—4 of FIG. 3 in the direction indicated by the arrows.
Figure 5:
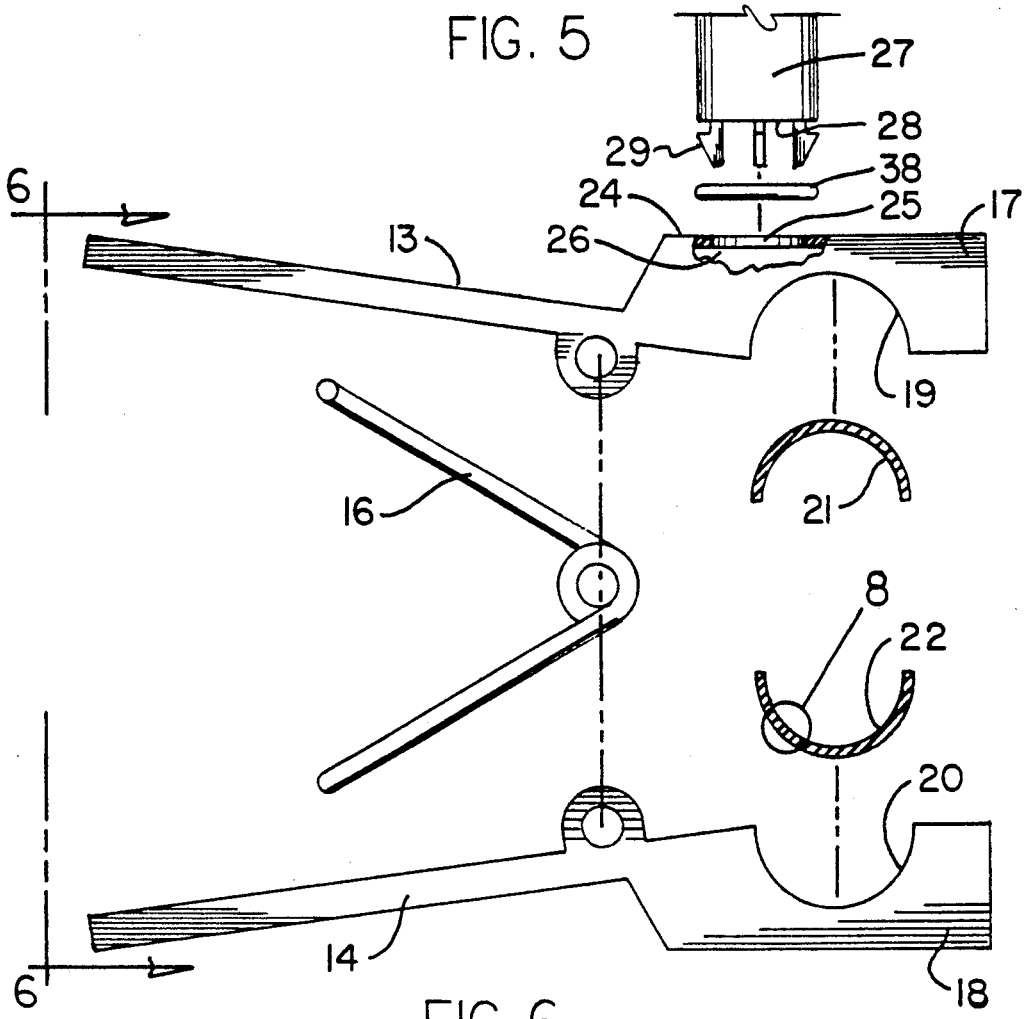
FIG. 5 is an exploded view of the cap structure of the invention.
Figure 6:
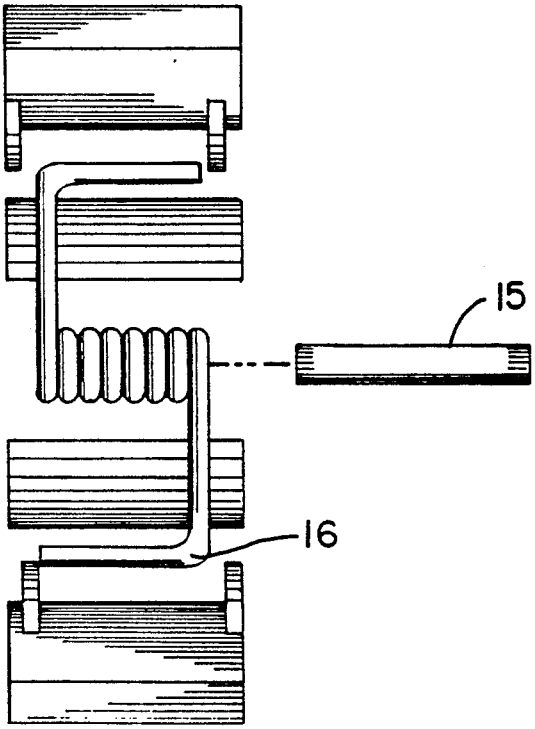
FIG. 6 is an orthographic view, taken along the lines 6—6 of FIG. 5 in the direction indicated by the arrows.

With reference now to the drawings, and in particular to FIGS. 1 to 8 thereof, a new and improved bed mounted tissue roll holder apparatus embodying the principles and concepts of the present invention and generally designated by the reference numeral 10 will be described.

More specifically, the bed mounted tissue roll holder apparatus 10 of the instant invention essentially comprises cooperation with a bed member 11, with the bed member 11 including at least one rail tube 12. The apparatus 10 includes a first clamp leg 13 spring-biased relative to a second clamp leg 14, wherein a pivot axle 15 is interposed intermediate the first and second clamp legs converging ends, with a clamp leg spring 16 wound about the pivot axle 15 between the first and second clamp legs 13 and 14. A first jaw 17 is mounted to the first clamp leg, with a second jaw 18 mounted to the second clamp leg, with the first and second jaws arranged in confronting relationship relative to one another, with the first jaw having a first jaw semi-cylindrical recess 19 arranged in confronting relationship relative to a second jaw semi-cylindrical recess 20. The first jaw semi-cylindrical recess 19 and the second jaw semi-cylindrical recess 20 are coaxially aligned relative to one another when the first jaw 17 is arranged in contiguous communication with the second jaw 18 in a first position, wherein in a second position, the first and second jaws 17 and 18 respectively are spread to receive the bed rail tube 12 therebetween. A first semi-cylindrical resilient insert 21 is mounted coextensively within the first jaw semi-cylindrical recess 19, with a second semi-cylindrical resilient insert 22 positioned coextensively within the second jaw semi-cylindrical recess 20. The first and second semi-cylindrical resilient inserts 21 and 22 each include engaging ribs 23 (see FIG. 8) coextensively about a facing surface of each of the inserts to enhance engagement with the rail tube 12.

The first jaw 17 includes a first jaw top wall 24 spaced relative to the first jaw recess 19. The top wall 24 includes a cylindrical opening 25 directed therethrough for access into a first jaw cavity 26. A mounting cylinder 27 is provided having a mounting cylinder first end 28, with a plurality of spring-biased legs 29 fixedly mounted to the first end 28 extending radially beyond the mounting cylinder 27 for engagement within the first jaw cavity 26 below the cylindrical opening 25. A resilient "O" ring 38 (see FIG. 5) is interposed between the first end 28 and the first jaw top wall 24 to tension the first end 28 relative to the top wall 24 for fixed positioning of the mounting cylinder 27 relative to the top wall 24 in orthogonal orientation.

The mounting cylinder 27 includes an externally threaded second end 30 arranged for threadedly receiving a cylindrical cap 31 thereon, wherein the cap 31 and the mounting cylinder 27 are coaxially aligned about an axis 27*a*. The cylindrical cap 31 includes a plurality of cap rods 32 orthogonally oriented relative to the axis 27*a* and project radially beyond the cylindrical cap 31 to secure the tissue roll "T" between the rods 32 and the top wall 24 in a rotative manner.

In this manner, ease of mounting and securing the tissue roll relative to the spring clip structure is provided, wherein the cap 31 is merely removed relative to the mounting cylinder 27 to permit ease of replenishment of the tissue roll "T".

Figure 7:
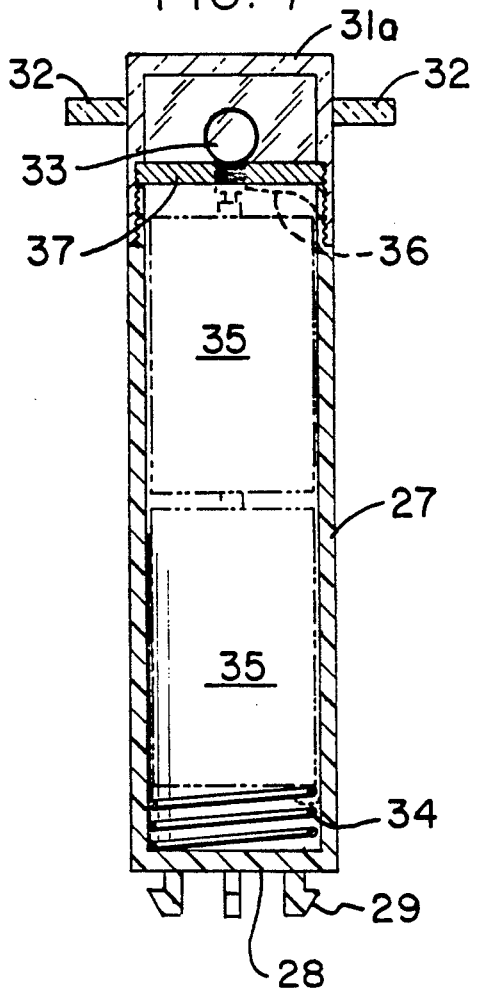
FIG. 7 is an isometric illustration of a modified cap structure employed by the invention.
Figure 8:
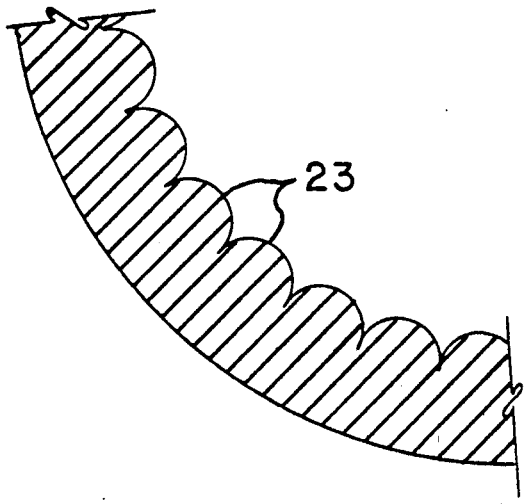
FIG. 8 is an enlarged orthographic view of section 8 as set forth in FIG. 5.

The FIGS. 7 and 8 indicate the use of a modified cap 31*a* that is formed with transparent material, wherein an illumination bulb mounting plate 37 is mounted within the cap 31*a* below the rods 32. An illumination bulb 33 is mounted within the mounting plate 37, wherein at least one battery member 35 is positioned within the mounting cylinder 27. A mounting cylinder spring 34 is interposed between the at least one battery member 35 and a mounting cylinder first end 28, with an electrical communication cable 36 directed from the battery member 35 to an illumination bulb 33 to complete electrical circuit providing illumination of the bulb 33. In this manner, the illumination bulb 33 of limited intensity provides for ease of orientation of the apparatus during conditions of limited available light for visibly accessing the tissue roll "T" during such conditions.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A bed mounted tissue roll holder apparatus arranged for mounting to a bed member rail tube of a bed member, wherein the apparatus comprises, a spring clamp assembly, including a first clamp leg and a second clamp leg, and the first clamp leg and the second clamp leg pivotally mounted relative to one another at intermediate locations with a pivot axle directed and mounted between the first clamp leg and the second clamp leg, with a clamp leg spring interposed between the first clamp leg and the second clamp leg, with the clamp leg spring wound about the pivot axle, and a first jaw mounted to the first clamp leg and a second jaw mounted to the second clamp leg, the first jaw having a first jaw semi-cylindrical recess, the second jaw having a second jaw semi-cylindrical recess, wherein the first jaw semi-cylindrical recess and the second jaw semi-cylindrical recess are coaxially aligned relative to one another, wherein the first jaw and the second jaw are in continuous communication relative to one another in a first position, wherein said clamp leg spring biases said first and second jaws toward said first position, with the first jaw and the second jaw arranged in a spaced relationship relative to a second position to receive the rail tube therebetween, and the first jaw having a first jaw top wall spaced from the first jaw semi-cylindrical recess, with the first jaw top wall including mounting means for mounting a tissue roll thereabout, and the first jaw semi-cylindrical recess includes a first semi-cylindrical resilient insert mounted coextensively with the first jaw semi-cylindrical recess, and the second jaw semi-cylindrical recess includes a second semi-cylindrical resilient insert mounted coextensively therewithin in confronting relationship relative to the first semi-cylindrical resilient insert, and the first semi-cylindrical resilient insert and the second semi-cylindrical resilient insert each includes engaging ribs parallel to each other and of resilient construction for enhanced engagement of the rail tube, and the top wall includes a cylindrical opening, and the first jaw having a first jaw cavity within the first jaw below the top wall in surrounding relationship relative to the cylindrical opening, and the mounting means includes a mounting cylinder for rotatably mounting said roll and having a mounting cylinder first end and a mounting cylinder second end, the mounting cylinder first end includes a plurality of spring-biased legs extending radially beyond the mounting cylinder and fixedly mounted to the mounting cylinder first end, with the spring-biased legs arranged for reception within the first jaw cavity, and a resilient "O" ring interposed between the mounting cylinder first end and the first jaw top wall, and the mounting cylinder second end is externally threaded, and a cylindrical cap threadedly mounted to the mounting cylinder second end, and the cylindrical cap and the mounting cylinder symmetrically oriented about a cylinder axis, and the cap having a plurality of rods longitudinally aligned relative to each other and orthogonally oriented relative to the cylinder axis, the rods project radially beyond the cap, and the cap is transparent, and includes a mounting plate therewithin, and an illumination bulb mounted to the mounting plate within the cap, and at least one battery member mounted within the mounting cylinder, and a mounting cylinder spring interposed between the battery member and the mounting cylinder first end, and an electrical communication cable directed from the mounting cylinder spring to the illumination bulb, with the battery member in simultaneous electrical communication with the illumination bulb for effecting illumination of the illumination bulb through the cap.

* * * * *